US011236450B2

(12) United States Patent
Padgett

(10) Patent No.: US 11,236,450 B2
(45) Date of Patent: Feb. 1, 2022

(54) EMBROIDERY FRAME

(71) Applicant: Allison Padgett, Santee, CA (US)

(72) Inventor: Allison Padgett, Santee, CA (US)

( * ) Notice: Subject to any disclaimer, the term of this patent is extended or adjusted under 35 U.S.C. 154(b) by 0 days.

(21) Appl. No.: 16/948,239

(22) Filed: Sep. 9, 2020

(65) Prior Publication Data

US 2021/0079576 A1 Mar. 18, 2021

Related U.S. Application Data

(60) Provisional application No. 62/901,070, filed on Sep. 16, 2019.

(51) Int. Cl.
*D05C 1/04* (2006.01)

(52) U.S. Cl.
CPC ..... *D05C 1/04* (2013.01)

(58) Field of Classification Search
CPC ... D05C 1/04; D05C 1/00; D05C 1/02; D06C 3/00; D06C 3/08; B44D 3/18; B44D 3/185
See application file for complete search history.

(56) References Cited

U.S. PATENT DOCUMENTS 1,242,972 A * 10/1917 Pettit ..... D05C 1/04 38/102.2
2,760,299 A * 8/1956 Gable ..... B44D 3/185 38/102.2
3,220,469 A * 11/1965 Oehmig ..... E06B 9/52 160/380
3,886,990 A * 6/1975 Campione ..... B44D 3/185 160/374.1
4,144,660 A * 3/1979 Lamb ..... B44D 3/185 160/378
4,597,206 A * 7/1986 Benson ..... A44C 3/001 24/103
4,726,130 A * 2/1988 Bussard ..... D05C 1/04 38/102.2
5,899,160 A * 5/1999 Hoag ..... D05B 35/12 112/475.22
6,279,644 B1 * 8/2001 Wylie ..... E06B 9/52 160/371

FOREIGN PATENT DOCUMENTS

FR 2830264 A1 * 4/2003

* cited by examiner

*Primary Examiner* — Ismael Izaguirre
(74) *Attorney, Agent, or Firm* — Law Office of Scott C Harris, Inc

(57) ABSTRACT

An embroidery hoop that doubles as a frame. The frame has a groove for holding a spline to hold embroidery material inside the frame.

17 Claims, 3 Drawing Sheets

EMBROIDERY FRAME

This application claims priority from provisional application No. 62/901,070, the entire contents of which are herewith incorporated by reference.

BACKGROUND

One type of existing embroidery frame is typically made of two same size hoops that use a screw tightening system to secure fabric between the two hoops. The hoops are typically made out of either wood or plastic.

Another type of frame uses plastic brackets that snap onto the sides of the frame to secure fabric across the frame.

Another type of frame uses a flexible rubber ring that snaps into the back of a frame front piece to secure fabric in a circular fashion.

Yet another type of frame uses adhesive to permanently secure fabric to the frame.

Limitations of existing technology include the following:

Embroidery hoops/frames are typically limited to circular and rectangular shapes due to the manner in which the existing frames stretch the fabric.

Many of such embroidery hoops/frames do not adequately secure fabric, requiring a user to re-adjust and re-secure multiple times while working on a project. Other such hoops and frames permanently attach the fabric and make it difficult or impossible to remove after use.

In addition, many devices of this type do not form a useful way to display embroidery based art.

SUMMARY

The inventor defines herein a new kind of embroidery frame that allows easy attachment and removal of fabric, and doubles as a frame for displaying the final embroidered piece. The frame uses spline to hold the material inside the frame during working. The spline can be any kind of material that fits in, and is held in, a groove that can hold both the spline and the material being held in place. Because of the novel holding system, the frame can be made in any shape: square, round, polygon or any other shape.

An embodiment describes an embroidery frame that serves as a functional embroidery hoop as well as an art framing system. The frame allows for the completion of embroidery and other fiber arts projects in a variety of shapes with a unique, no-slip fabric stretching system that is ready to display.

In one embodiment, the frame can function as a picture frame for display purposes upon completion.

BRIEF DESCRIPTION OF THE DRAWINGS in the drawings:

the drawings show embodiments of the invention, and specifically:

DETAILED DESCRIPTION

An embodiment is described herein with reference to the figures.

Figure 1:
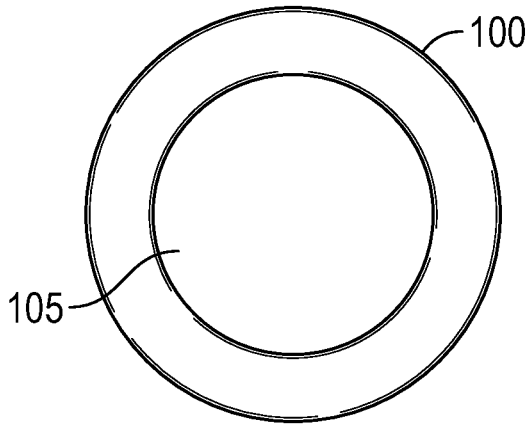
FIG. 1 illustrates a front view of the frame.

FIG. 1 illustrates a basic layout/diagram of an embodiment showing an embroidery frame. FIG. 1 shows the front of a circular frame 100. In embodiments, the frame can also be in many other shapes such as a cloud, hexagon, semicircle, or any geometric shape of any type. The frame 100 is formed of a piece of rigid material, such as wood, composite or plastic. The center 105 of the frame is cut out, and the inside portion of the inner surfaces of the center 105 of the frame serves as the display area and also the functional working area once the fabric is attached, as described herein.

Figure 2:
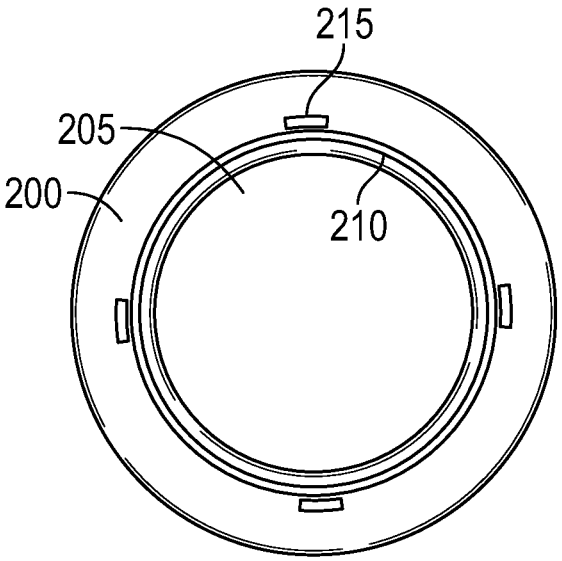
FIG. 2 illustrates the rear view of the frame having a recess on its rear side, and having screw turn buttons to hold a rear piece.

The rear side of the frame is shown in FIG. 2. The rear side surface 200 includes a recess 205, also called a rabbet, in this embodiment having a depth of 0.25 inches extending all the way around the inner edge of the frame, and in contact with the open center 105 of the frame. A 3/16" wide channel 210 is formed just inside the inside edge of the rabbet, and extends to a depth of 0.625 inch. More generally, however, the channel is deeper than the rabbet. This channel 210 serves as an insert for a spline material (400 in FIG. 4) which is inserted into the channel 210 and recess 205 to be held frictionally in the channel and to hold fabric.

The spline material can be any kind of material that can be inserted into the channel and used to hold the fabric in place.

In an embodiment, a removable adhesive is also applied to the spline channel 210.

Turn buttons 215 are 2-10 buttons which are screwed into the outside edge of the back side of the frame front to hold the frame back piece (300 in FIG. 3) into place. In one position, as shown in FIG. 2, the turn buttons have surfaces which are turned to allow the entire rabbet to be exposed, such that a rear portion (the frame back 300 shown in FIG. 3) can be inserted and removed. In the other position of the turn buttons 215, they can be placed so that the surfaces of the frame buttons hold the frame back 300 into place.

Figure 3:
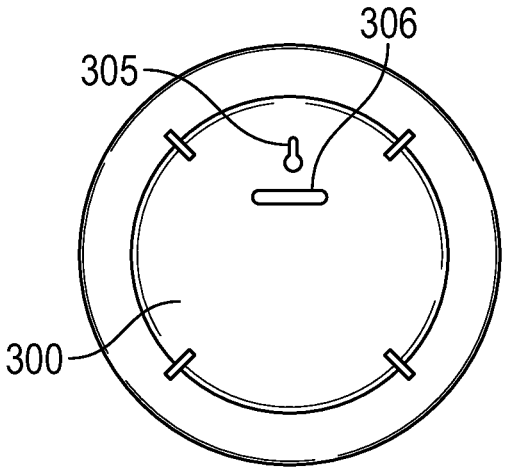
FIG. 3 illustrates the rear piece which is held within the recess in the rear of the frame.

The frame back 300 is shown in FIG. 3; and is formed from a ⅛ inch thick piece of structural material, e.g. wood composite or plastic, that is cut into the same size and shape as the outer edge of the rabbet 205. The frame back 300 should have approximately the same thickness as the depth of the rabbet. In this embodiment, rabbet is slightly deeper than the thickness of the frame back 300, to allow some leeway and warpage of the frame back 300. The spline material also needs to have a size/thickness such that it does not extend outside the channel into the area of the rabbit, and when the spline material is attached, the rear surface can be placed over the spline material without interfering with the spline material.

The frame back 300 also includes cutouts such as 305 which can be used for hanging the frame, and/or a slot 306 which can be used to insert an optional frame stand.

Figure 4:
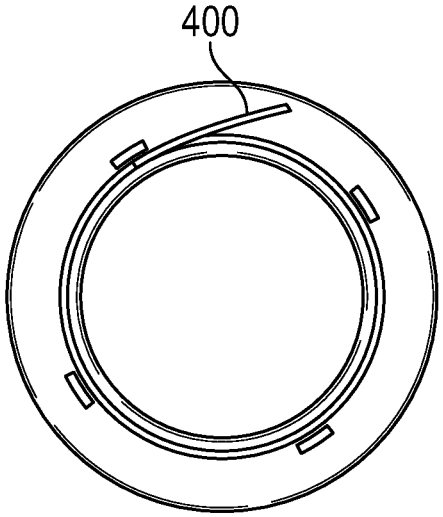
FIG. 4 illustrates a spline material being included in the channel and the recess.
Figure 5:
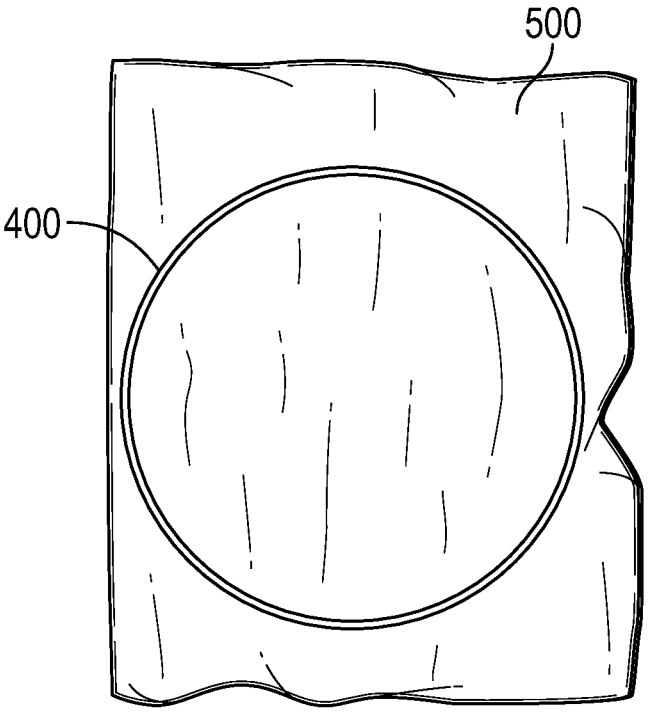
FIG. 5 shows how the spline is located on a piece of material.

In operation, a piece of spline material 400 that has a diameter of 0.14 inches to 0.19 inches is cut to the length of the circumference of the frame channel 210. The fabric is placed over the frame channel as shown in FIGS. 4 and 5, and then the spline 400 is inserted into the frame channel as shown in FIG. 4 to hold the fabric in place.

Figure 6:
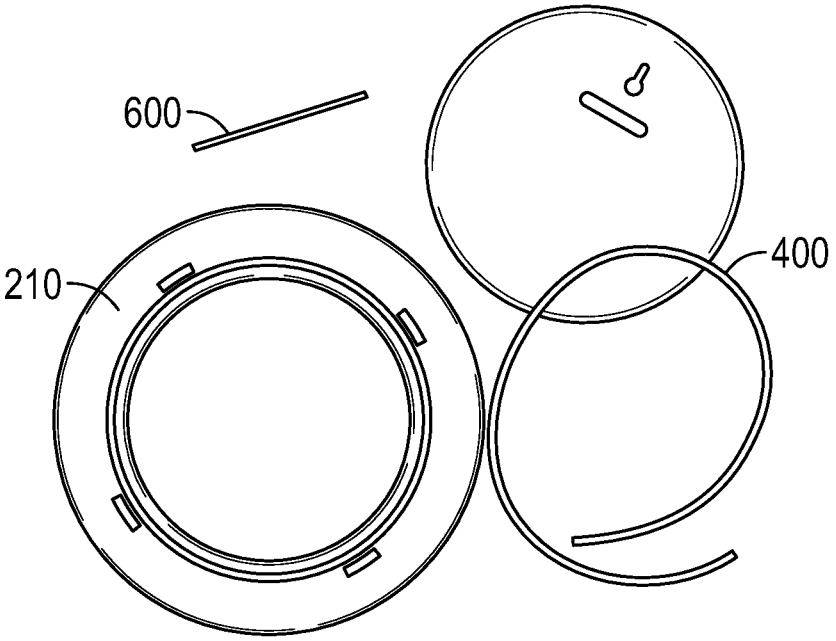
FIG. 6 shows the care including the frame, spline, and other pieces.

In one embodiment, the kit can include the parts shown in FIG. 6. A spline tool 600 can be formed as a 5.25" long wooden dowel having a diameter of a ¼ inch and a pointed but rounded end. This tool can be used to press the spline 400 into the slot 210. The kit can also be sold with a quarter inch thick rectangular piece of wood composite or plastic to act as a frame stand.

Figure 7:
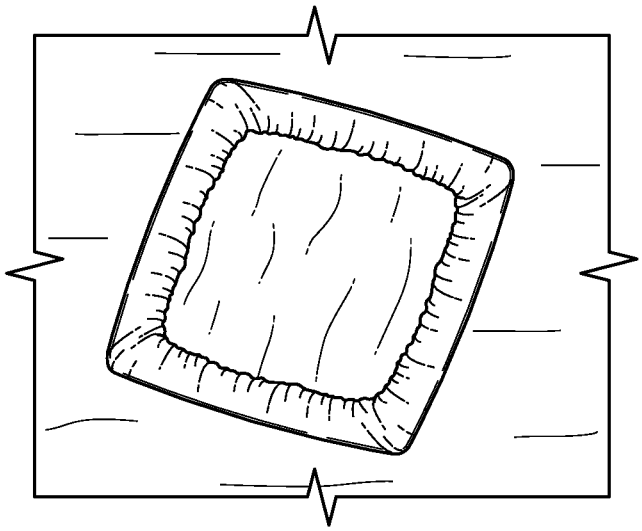
FIG. 7 shows a protective frame cover.

A removable elastic band formed of fabric that stretches over the sides of the frame front can act as a protective cover as shown in FIG. 7, while the frame is being used as an embroidery hoop. This cover can be determined by the diameter of the frame.

In operation, the embroiderer starts by tightly stretching fabric over the opening 105, and pressing this fabric into the channel 210 using the spline 400. FIG. 5 illustrates the fabric 500 being stretched into the opening, and held by the spline 400 into place. Once held in this way, the embroidery can be carried out with the fabric 500 held within the frame. Once the embroidery is finished, the frame functions as a ready to display fixture frame since it is already stretched, has a built-in hanging system, and has a glazing-free front that allows for greater breathability. Many picture frames that were previously used to display embroidery art have glazing or a covered front, which is believed by the inventor not suitable for embroidery projects.

The rear side of the frame is removed by turning the turn buttons 215, and removing the back cover 300. Then, the piece of fabric 500 is placed right side down on the backside of the frame front. The fabric is stretched and pressed onto the temporary adhesive on recess 210. Next, taking the wooden tool, the spline is pressed into the channel on the backside of the fabric of the backside of the frame front pushing the fabric into the channel while working your way around the frame. The fabric can be tightened or adjusted by pulling the spline out and repositioning the fabric by removing it from the temporary adhesive.

Once the desired fabric tension is been achieved, the embroidery project can be carried out directly on the frame. When finished, the user can trim the excess fabric, replace the frame back, and use the frame for tabletop or wall display.

The frame components described herein can be made of any of a variety of materials as described herein. This patent application contemplates adjusting to accommodate different size splines, different size back portions, different size fabric thicknesses and different kinds of desired displays.

The system as described herein produces significant advantages as compared with other systems. The embodiment provides an ideal form for displaying an embroidery project. Since there is no transparent window, the embroidery project will not degrade due to trapped moisture as other frames with similarly degrade. The frame allows making literally any kind of shape including circular, rectangular, cloud shapes, irregular shaped, hexagon, triangle, octagon, half circle, heart-shaped or any other shape.

Due to the manner in which the system stretches the fabric, any of a number of different shapes can be used.

The system can secure the fabric using spline and an adhesive, allowing the user to avoid having to re-tighten the fabric as they work on the project. The system works as both a embroidery hoop and as a picture frame, and thus does not require reframing the projects upon completion. The picture frame can either be hung on the wall with a built-in picture hanger or can be displayed on a tabletop using the stand. If the material is not as desired, the material can be easily removed.

By using both removable adhesive and spline to hold the material into place, this forms a system which is simplified for a user to attach the material, but also easily removable in the event of a mistake or the like.

Although only a few embodiments have been disclosed in detail above, other embodiments are possible and the inventors intend these to be encompassed within this specification. The specification describes certain technological solutions to solve the technical problems that are described expressly and inherently in this application. This disclosure describes embodiments, and the claims are intended to cover any modification or alternative or generalization of these embodiments which might be predictable to a person having ordinary skill in the art.

What is claimed is:

1. An embroidery frame, comprising:

a frame, having a first shape, the frame having an outer edge which defines the outer edge of the frame, and having an inner edge, whose perimeter defines an opening in the frame, the frame having a front and a rear surface, the rear surface of the frame having an indentation around the perimeter of the inner edge, the indentation being of a first specified thickness, and extending entirely around the inner edge;

a channel, formed in the inner edge, extending to a depth which is deeper than a thickness of the indentation;

a spline material, formed inside the depth, and held frictionally in the channel, a frame back, which fits inside the indentation in the rear surface of the frame, the frame back being slightly thinner than the first specified thickness of the indentation, and held completely in the indentation, and where the spline material has a thickness to hold the spline material in the channel at a level below the a top surface of the indentation, such that the frame back lays flat in the indentation when the spline is in place in the channel.

2. The embroidery frame as in claim 1, wherein the frame has an outer surface that is circular and an inner surface that is circular.

3. The embroidery frame as in claim 1, wherein the frame has an outer surface that is substantially rectangular with rounded edges and an inner surface that is substantially rectangular with rounded edges.

4. The embroidery frame as in claim 1, further comprising an embroidery fabric, located over the rear of the frame, held in place by the spline in the channel, and covered with the frame back.

5. The embroidery frame as in claim 1, further comprising turn buttons on an outside edge of a rear of the frame to hold the frame back in place.

6. The embroidery frame as in claim 1, wherein the frame back includes inner surfaces therein enabling embroidery frame to be displayed by hanging from a display surface.

7. The embroidery frame as in claim 1, wherein the first specified thickness of the indentation is 0.25 inches, and the frame back has a thickness of ⅛ inch.

8. The embroidery frame as in claim 1, wherein the frame back, when in place, covers the spline.

9. The embroidery frame as in claim 4, further comprising a wooden spline tool, which presses the spline into the channel on the backside of the frame.

10. The embroidery frame as in claim 4, further comprising temporary adhesive, holding the embroidery fabric in place while the spline is attached.

11. A method of putting embroidery material into an embroidery frame, comprising:

attaching an embroidery material to a rear side of an embroidery frame using a temporary adhesive, the embroidery frame having a first shape, having an outer edge, and having an inner edge, whose perimeter defines an opening in the frame, and where the embroidery material is held at least to cover an entirety of the inner edge over a rear surface of the frame;

the rear surface of the frame having an indentation around the perimeter of the inner edge, the indentation being of a first specified thickness, and extending entirely around the perimeter of the inner edge, the rear surface of the frame having a channel, formed in the inner edge, extending below a surface of the indentation;

attaching a spline material, inside the channel, to be held frictionally in the channel, the spline material, when in the channel, holding the embroidery material, but not extending above the surface of the indentation; and after attaching the spline material to the material, placing a frame back inside the indentation, the frame back being slightly thinner than a depth of the indentation, and held completely in the indentation, and where the spline material has a thickness to hold the spline material in the channel at a level below the surface of the indentation, such that the frame back lays flat in the indentation.

12. The method as in claim 11, wherein the frame has an outer surface that is circular and an inner surface that is circular.

13. The method as in claim 11 wherein the frame has an outer surface that is substantially rectangular with rounded edges and an inner surface that is substantially rectangular with rounded edges.

14. The method as in claim 11, further comprising using turn buttons on an outside edge of a rear of the frame to hold the frame back in place.

15. The method as in claim 11, wherein the indentation has a thickness of 0.25 inches, and the frame back has a thickness of ⅛ inch.

16. The method as in claim 11, wherein the frame back, when in place, covers the spline.

17. The method as in claim 11, further comprising using a wooden spline pool, which presses the spline into the channel on the backside of the frame.

* * * * *